US011317770B2

(12) United States Patent
Isomura et al.

(10) Patent No.: US 11,317,770 B2
(45) Date of Patent: May 3, 2022

(54) TOILET SEAT DEVICE

(71) Applicant: LIXIL Corporation, Tokyo (JP)

(72) Inventors: Takahide Isomura, Kariya (JP); Keishi Horiuchi, Kariya (JP); Toru Katayama, Kariya (JP); Masato Takeda, Tokyo (JP); Daisuke Matsumoto, Tokyo (JP); Kenji Takemura, Tokyo (JP)

(73) Assignee: LIXIL Corporation, Tokyo (JP)

( * ) Notice: Subject to any disclaimer, the term of this patent is extended or adjusted under 35 U.S.C. 154(b) by 0 days.

(21) Appl. No.: 16/963,816

(22) PCT Filed: Jan. 18, 2019

(86) PCT No.: PCT/JP2019/001388
§ 371 (c)(1),
(2) Date: Jul. 21, 2020

(87) PCT Pub. No.: WO2019/142888
PCT Pub. Date: Jul. 25, 2019

(65) Prior Publication Data

US 2020/0359855 A1 Nov. 19, 2020

(30) Foreign Application Priority Data

Jan. 22, 2018 (JP) ..... JP2018-007761

(51) Int. Cl.
*A47K 13/24* (2006.01)
*G09G 3/32* (2016.01)

(52) U.S. Cl.
CPC ..... *A47K 13/24* (2013.01); *G09G 3/32* (2013.01)

(58) Field of Classification Search
CPC ..... A47K 13/24
USPC ..... 4/237, 234, 98, 217, 238, 239, 235, 4/245.1, 246.1; 297/188.09, 250.1
See application file for complete search history.

(56) References Cited

FOREIGN PATENT DOCUMENTS

| | | | |
|---|---|---|---|
| JP | H2-7692 | U | 1/1990 |
| JP | 2003-85521 | A | 3/2003 |
| JP | 2003-116746 | A | 4/2003 |
| JP | 2006-304821 | A | 11/2006 |
| JP | 2009-207568 | A | 9/2009 |
| JP | 2010-113998 | A | 5/2010 |
| JP | 4915596 | B2 | 4/2012 |
| JP | 2013-85707 | A | 5/2013 |
| JP | 2015-129437 | A | 7/2015 |

(Continued)

OTHER PUBLICATIONS

Notification dated Dec. 7, 2021, directed to JP Application No. 2018-007761; 4 pages.

*Primary Examiner* — Lori L Baker
(74) *Attorney, Agent, or Firm* — Morrison & Foerster LLP

(57) ABSTRACT

Provided is a device to prevent filth from collecting on a display of a toilet seat device. A toilet seat device of some embodiments includes a body part having a casing formed so as to be hollow, a toilet seat that is formed so as to be hollow and is supported in the casing; a light emitter that is accommodated in one of the casing and the toilet seat and is provided so as to be capable of emitting light, and a display that is provided at a prescribed location on the one of the casing and the toilet seat, the display indicating an operation state by emitted light from the light emitter. The display is provided with a base part; and a thin-walled part that is formed so as to have a lower thickness than does the base part, the thin-walled part transmitting light and indicating an operation state.

13 Claims, 6 Drawing Sheets

(56) References Cited

FOREIGN PATENT DOCUMENTS

| | | | |
|---|---|---|---|
| JP | 2017-66651 | A | 4/2017 |
| JP | 1588623 | S | 10/2017 |

TOILET SEAT DEVICE

CROSS-REFERENCE TO RELATED APPLICATIONS

This application is a national stage application under 35 USC 371 of International Application No. PCT/JP2019/001388, filed Jan. 18, 2019, which claims the priority of Japanese Application No. 2018-007761, filed Jan. 22, 2018, the entire contents of each of which are incorporated herein by reference.

FIELD OF THE DISCLOSURE

The present disclosure relates to a toilet seat device.

As a type of toilet seat device, the one shown in Patent Document 1 is known. As shown in FIGS. 1 to 4 of Patent Document 1, this toilet seat device includes an outer contour 5 of a functional device and a display device 4 provided above the outer contour 5. The display device 4 includes a display light emitter 8 arranged in the outer contour 5 and having an LED 8a to display the operation state of the functional device, and a protective member 9 that protects a plurality of display windows 6 and LEDs 8a provided on the outer contour 5 and has a convex light guide part 10 that is fitted into the display window 6 and emits light from the LED 8a to the outside. The protective member 9 includes a groove part 12 for protecting the LED 8a by escaping water invading through the gap between the peripheral edge of the display window 6 and the convex light guide part 10.

Patent Literature 1 Japanese Patent (Granted) Publication No. 4915596

SUMMARY OF THE DISCLOSURE

However, in the above-described toilet seat device of Patent Document 1, it is conceivable that dirt may accumulate in the gap around the periphery of the display window 6 and the appearance of the display device 4 (display) may deteriorate.

The present disclosure has been made to solve the above-mentioned problems, and an object of the present disclosure is to make it difficult for dirt to collect in the display of the toilet seat device.

In order to solve the above-mentioned problems, a toilet seat device of some embodiments includes a body part including a casing formed so as to be hollow; a toilet seat formed so as to be hollow and is supported by the casing; a light emitter that is accommodated in one of the casing and the toilet seat and is provided so as to be capable of emitting light; and a display that is provided at a prescribed location on the one of the casing and the toilet seat, the display indicating an operation state by light emitted by the light emitter, wherein the display includes: a base part; and a thin-walled part that is formed so as to have a smaller thickness than the base part, the thin-walled part transmitting the light emitted by the light emitter to indicate the operation state.

DETAILED DESCRIPTION OF THE DISCLOSURE

Figure 1:
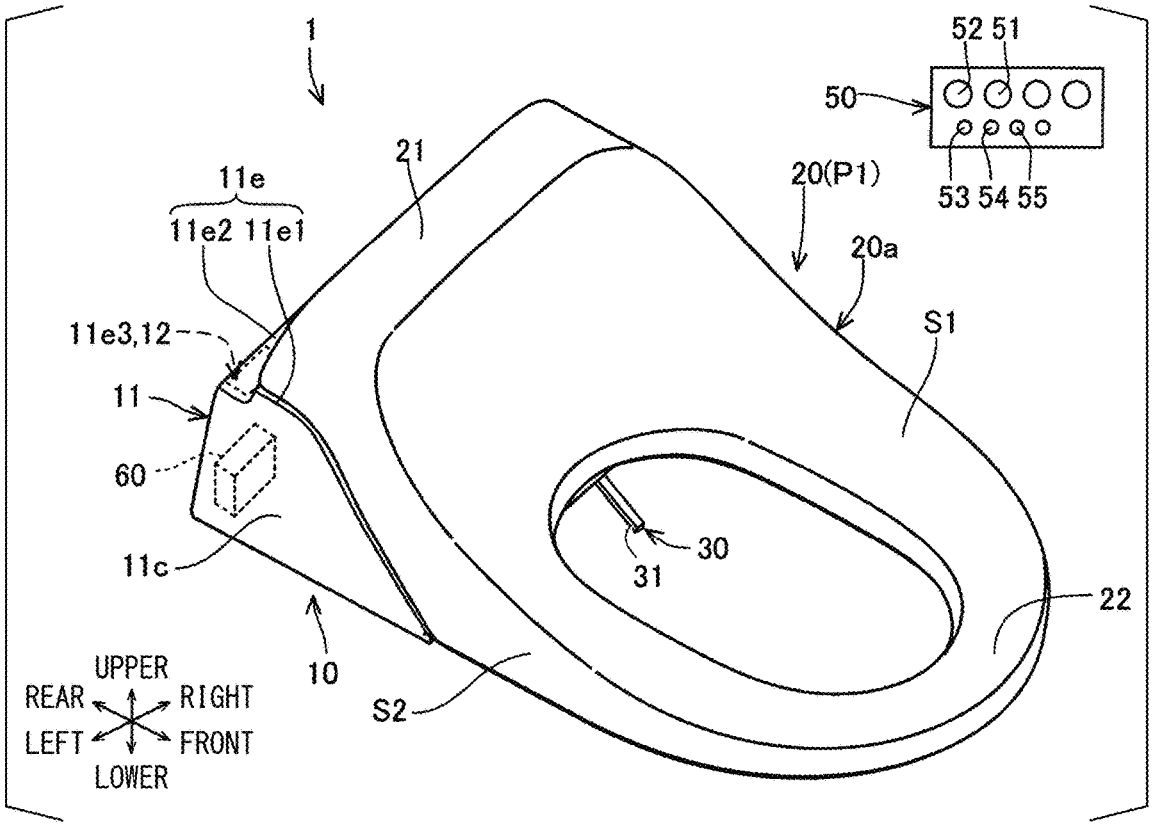
FIG. 1 is a perspective view of the toilet seat device including a display according to some embodiments, showing a case where the toilet seat is in a closed state, according to some embodiments.

Hereinafter, the toilet seat device 1 of some embodiments will be described. In the present specification, for convenience of description, the upper side and the lower side in FIG. 1 are the upper side and the lower side of the toilet seat device 1, respectively, the upper left side and the lower right side in FIG. 1 are the rear side and the front side of the toilet seat device 1, respectively, and the lower left side and the upper right side in FIG. 1 are the left side and the right side of the toilet seat device 1, respectively.

According to some embodiments, the toilet seat device 1 is a warm water washing toilet seat. The toilet seat device 1 includes a body part 10, a toilet seat 20, and a nozzle 30.

The body part 10 is attached to, for example, a sitting toilet (not shown) installed in a public toilet room. As shown in FIGS. 1 to 7, the body part 10 includes a casing 11, a display 12, and a light emitter 13.

The casing 11 formed to be hollow. The casing 11 is formed substantially symmetrically. The casing 11 is formed with a substantially constant wall thickness. The casing 11 is formed by injection molding a thermoplastic resin. As shown in FIGS. 1 to 5, the casing 11 includes a lower part 11*a*, a front part 11*b*, a first lateral part 11*c*, a rear part 11*d*, a top face 11*e*, and a pair of support parts 11*f*.

Figure 2:
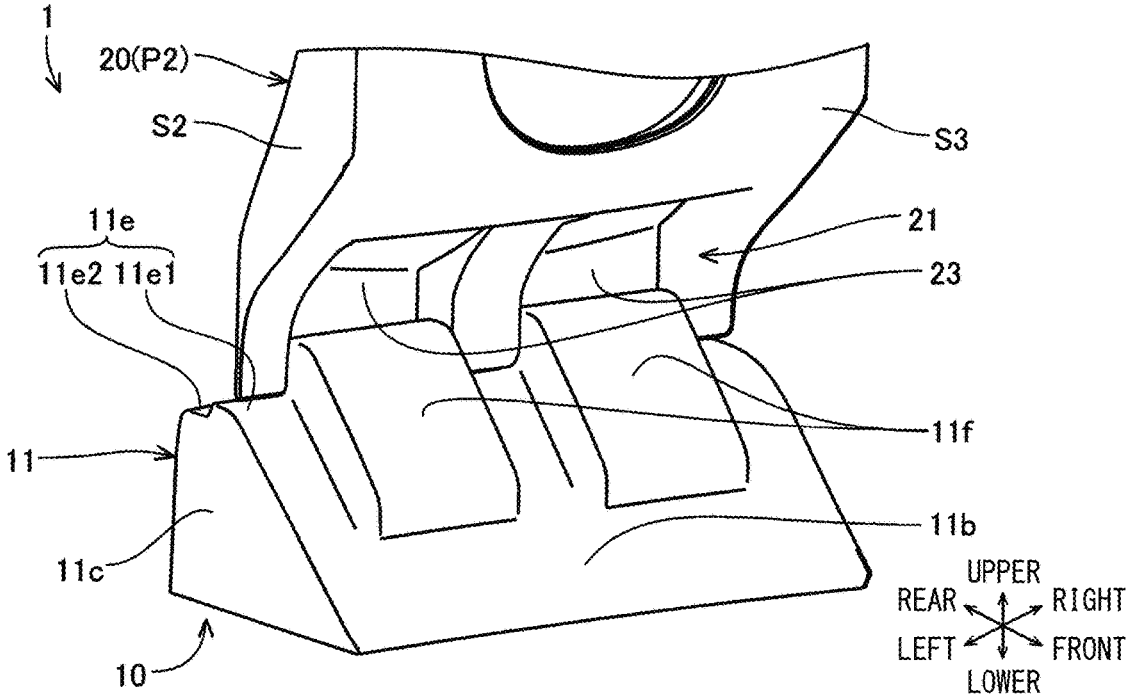
FIG. 2 is a perspective view of the toilet seat device shown in FIG. 1, showing a case where the toilet seat is in an open state, according to some embodiments.
Figure 3:
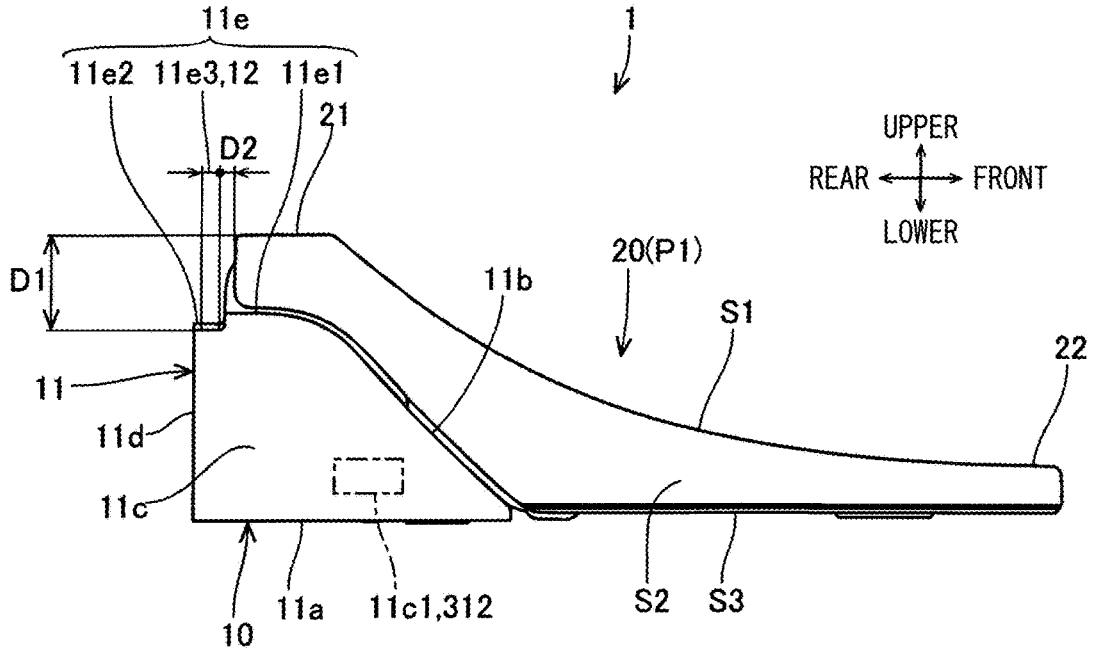
FIG. 3 is a side view of the toilet seat device shown in FIG. 1, according to some embodiments.
Figure 4:
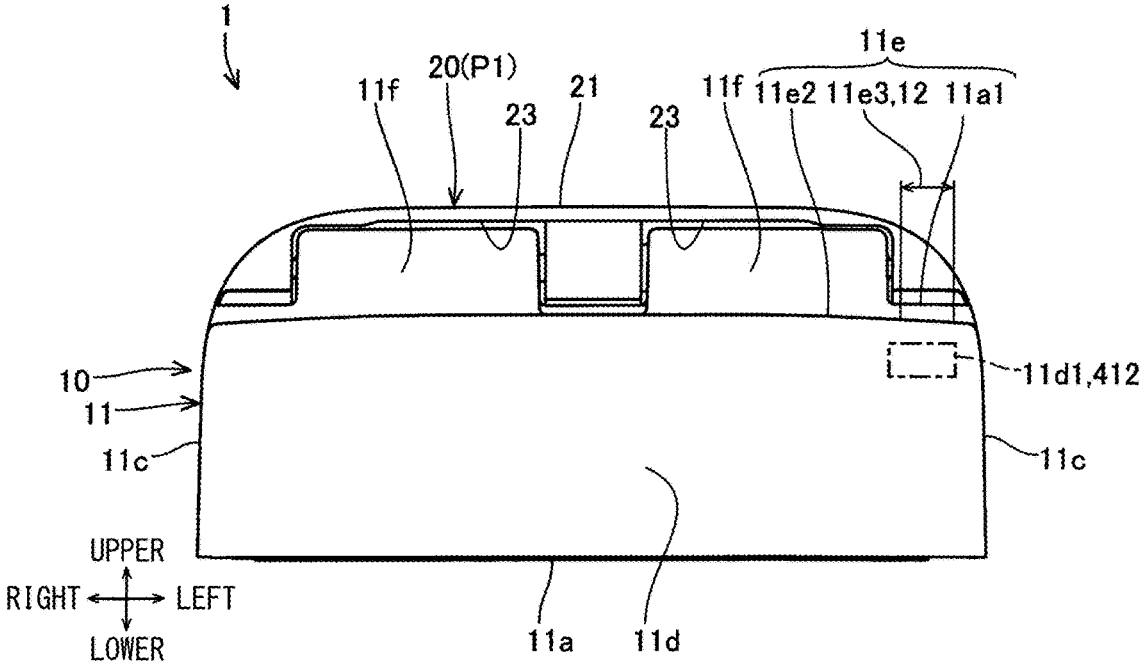
FIG. 4 is a rear view of the toilet seat device shown in FIG. 1, according to some embodiments.
Figure 5:
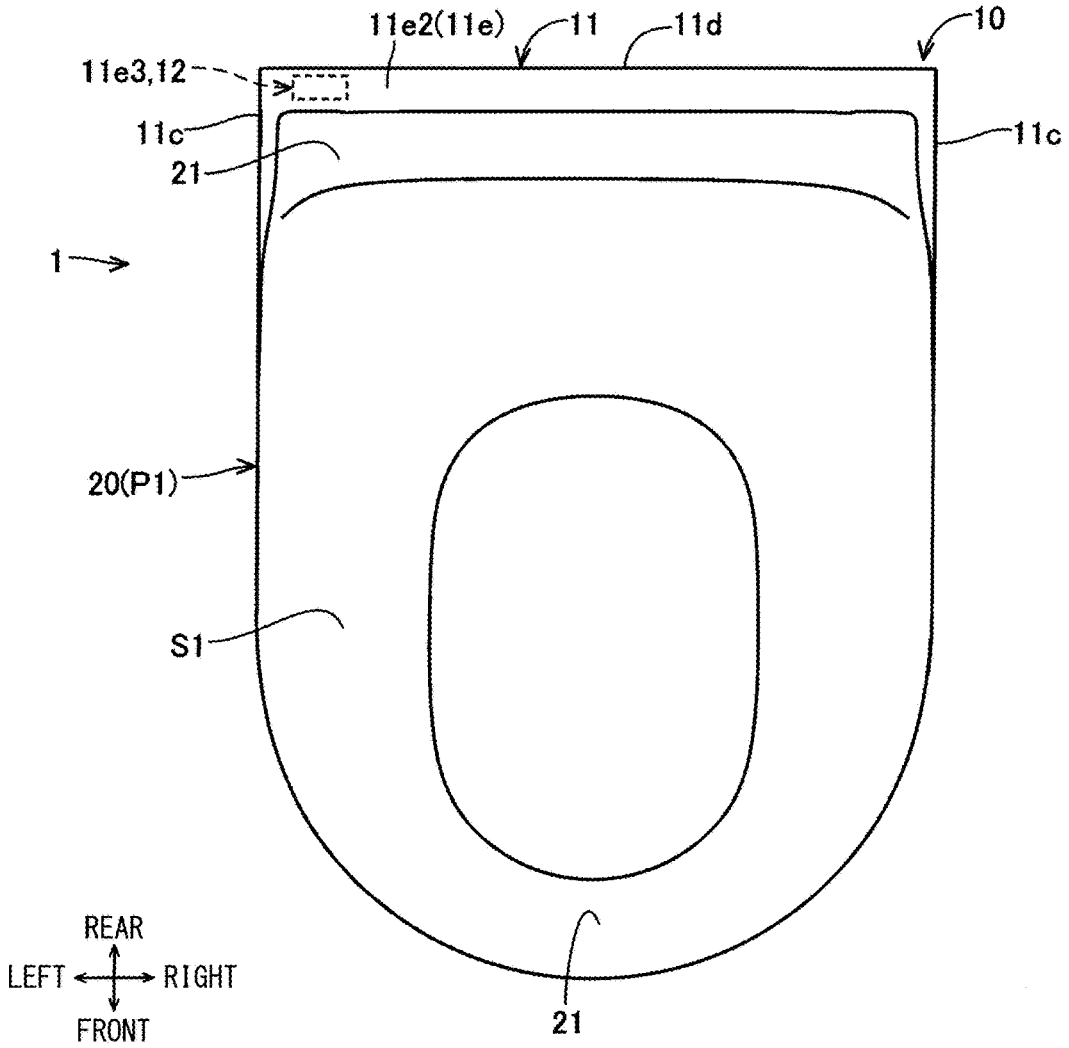
FIG. 5 is a top view of the toilet seat device shown in FIG. 1, according to some embodiments.

The lower part 11*a* is a portion on the lower side of the casing 11 and is a portion attached to the sitting toilet (see FIGS. 3 and 4). The front part 11*b* is a portion on the front side of the casing 11, and is formed so as to incline from the upper side to the lower side from the rear side to the front side (see FIGS. 2 and 3). The first lateral part 11*c* is a portion on the left side and the right side of the casing 11, and is formed in a trapezoidal shape in a side view so as to extend substantially vertically (see FIGS. 1 to 3). The rear part 11*d* is a portion on the rear side of the casing 11, and is formed in a rectangular shape in a rear view so as to extend substantially along the vertical direction (see FIG. 4).

The top face 11*e* is a portion on the upper side of the casing 11. The top face 11*e* is formed in a side view step shape in which the front side part is the upper step part 11*e*1 and the rear side part is the lower step part 11e2 (see FIGS. 1 to 4). The lower step part 11e2 is formed so as to incline slightly from the upper part to the lower part as it goes from the center part in the left-right direction to the left end, and slightly incline from the upper part to the lower part as it goes from the center part in the left-right direction to the right end. (See FIG. 4).

The pair of support parts 11f are portions that rotatably support the toilet seat 20. The pair of support parts 11f are formed so as to bulge upward from the upper step part 11e1 of the top face 11e to the center part of the front part 11b in the front-rear direction, and are formed side by side along the left-right direction. (See FIG. 2). The pair of support parts 11f rotatably supports the toilet seat 20 at a portion above the upper step part 11e1 of the top face 11e.

The display 12 indicates the operation state by the light emission of the light emitter 13. The operation state is an on/off state of the power of the toilet seat device 1, an on/off state of the power saving mode, and a state of whether or not it is time to inspect the toilet seat device 1.

The power saving mode is a control mode for suppressing the power consumption of the toilet seat 20 (details will be described later). The toilet seat device 1 may be inspected, for example, when a predetermined time (for example, two years in a case where the installation place is a public toilet room) has passed since the toilet seat device 1 was installed and the power was first turned on.

As shown in FIGS. 1 to 7, the display 12 is provided at a predetermined portion 11e3 of the top face 11e of the casing 11. The predetermined portion 11e3 is provided at the left end part of the lower step part 11e2 of the top face 11e. That is, the display 12 is provided so as to be located behind and below the upper step part 11e1. Further, since the lower step part 11e2 is provided so as to be inclined as described above, the predetermined portion 11e3 is provided so as to be inclined from the upper side to the lower side from the right side to the left side of the top face 11e.

Figure 6:
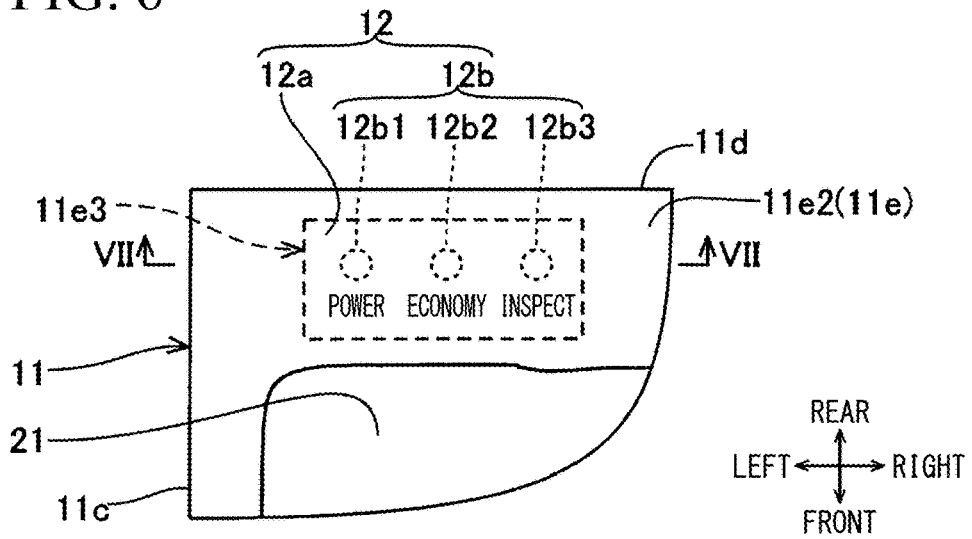
FIG. 6 is a top view of the display shown in FIG. 1, according to some embodiments.
Figure 7:
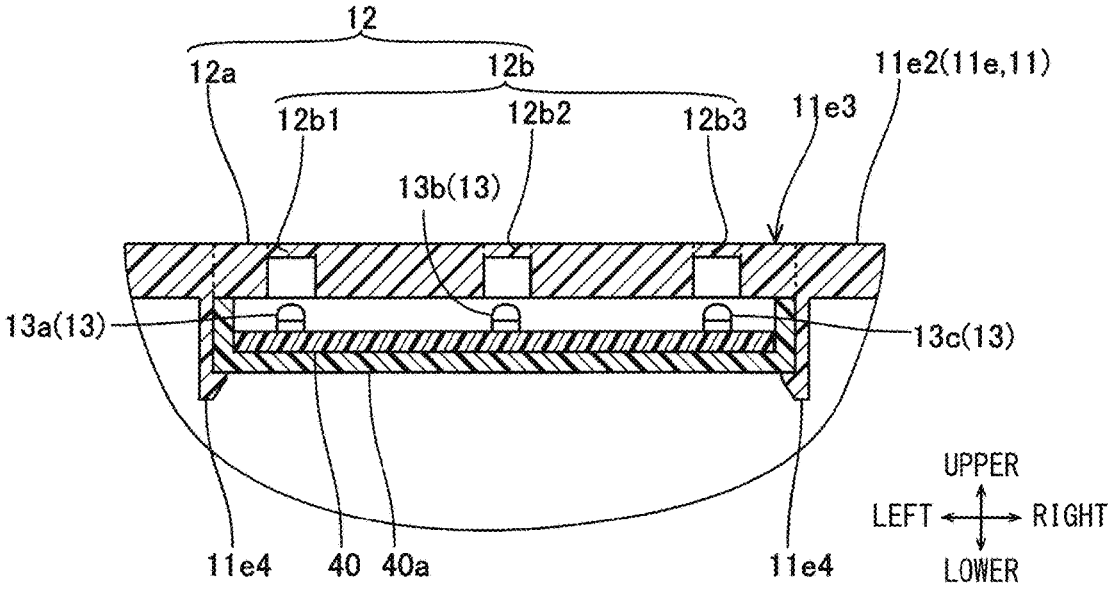
FIG. 7 is a sectional view of the display taken along line VII-VII shown in FIG. 6, according to some embodiments.

Further, the display 12 and the casing 11 are integrally formed. Since the predetermined portion 11e3 is inclined as described above, the outer surface of the display 12 is also inclined similarly to the outer surface of the predetermined portion 11e3. As shown in FIGS. 6 and 7, the display 12 includes a base part 12a and a plurality of thin-walled parts 12b.

The base part 12a is a portion corresponding to the predetermined portion 11e3 of the casing 11, and is formed to have the same thickness as the predetermined portion 11e3. The base part 12a is provided with a plurality of thin-walled parts 12b.

The plurality of thin-walled parts 12b are formed to have a smaller thickness than the base part 12a, and transmit the light emitted from the light emitter 13 to indicate an operation state. The plurality of thin-walled parts 12b are formed so as to be recessed from the inner surface of the base part 12a. The plurality of thin-walled parts 12b are formed so as to be recessed in a cylindrical shape. As a result, the outer surface of the display 12 is formed by the same curved surface as the outer surface of the lower step part 11e2 of the top face 11e, and no step or gap is formed on the outer surface of the casing 11. The plurality of thin-walled parts 12b are formed by injection molding the casing 11. As described above, since the display 12 is provided in the casing 11, the casing 11 corresponds to "one member" in some embodiments.

The first thin-walled part 12b1 indicates an on/off state of the power source. In front of the first thin-walled part 12b1 on the outer surface of the display 12, the character "power" is printed. The second thin-walled part 12b2 shows an on/off state of the power saving mode. In front of the second thin-walled part 12b2 on the outer surface of the display 12, a character "power saving" is printed. The third thin-walled part 12b3 indicates whether or not it is time to inspect the toilet seat device 1. The character "inspection" is printed in front of the third thin-walled part 12b3 on the outer surface of the display 12.

As shown in FIG. 7, the light emitter 13 is accommodated in the casing 11 and provided so as to emit light. A plurality of (three in the present embodiment) light emitters 13 are provided. The light emitter 13 is, for example, a light emitting diode (LED). The light emitter 13 is arranged on one surface of the substrate 40. The substrate 40 is formed in a plate shape with an insulating material such as ceramics, and an electric circuit (not shown) for causing the light emitter 13 to emit light is provided on one surface thereof. The board 40 is accommodated in a box-shaped case 40a having an open top, and is fixed to the inside of the casing 11 together with the case 40a by a plurality of hook parts 11e4 integrally provided inside the top face 11e of the casing 11.

The first light emitter 13a is arranged so as to face the first thin-walled part 12b1 and emit light toward the first thin-walled part 12b1. The first light emitter 13a lights up in green when the power of the toilet seat device 1 is on, and turns off when the power of the toilet seat device 1 is off. When the first light emitter 13a is turned on, the first thin-walled part 12b1 transmits the light from the first light emitter 13a and is turned on in a circular shape in a top view. This indicates that the power is on.

The second light emitter 13b is arranged so as to face the second thin-walled part 12b2 and emit light toward the second thin-walled part 12b2. The second light emitter 13b lights up in green when the power saving mode is in the on state, and turns off when the power saving mode is in the off state. When the second light emitter 13b is turned on, the second thin-walled part 12b2 transmits the light from the second light emitter 13b and is turned on in a circular shape in a top view. This indicates that the power saving mode is on.

The third light emitter 13c is arranged so as to face the third thin-walled part 12b3 and emit light toward the third thin-walled part 12b3. The third light emitter 13c lights up in red when it is time to inspect the toilet seat device 1, and turns off when it is not time to inspect. When the third light emitter 13c is turned on, the third thin-walled part 12b3 transmits the light from the third light emitter 13c and is turned on in a circular shape in a top view. This indicates that it is time to check the toilet seat device 1.

The toilet seat 20 is supported by the casing 11, as shown in FIGS. 1 to 5. The toilet seat 20 is rotatably supported by a pair of supporting parts 11f of the body part 10 at a rear end part 21 between a closed state P1 and an open state P2. The closed state P1 is a state in which the tip 22 faces forward and the seating surface S1 on which the user sits faces upward, and the user can sit on the seating surface S1 (see FIG. 1). The open state P2 is a state in which the tip 22 faces upward, and the user cannot sit on the seating surface S1 (see FIG. 2).

The toilet seat 20 is provided in an annular shape in a top view in the closed state P1. The toilet seat 20 is provided so as to cover the top face 11e when the toilet seat 20 is in the closed state P1. Specifically, when the toilet seat 20 is in the closed state P1, the rear end part 21 is formed to extend along the casing 11 from the front part 11b of the casing 11 to the upper step part 11e1 of the top face 11e. That is, the rear end part 21 of the toilet seat 20 covers the front side part (upper step part 11*e*1) of the top face 11*e* when the toilet seat 20 is in the closed state P1.

As described above, the predetermined portion 11*e*3 and thus the display 12 are provided behind and below the upper step part 11*e*1 (the front side part of the top face 11*e*) and the rear end part 21 of the toilet seat 20. Therefore, when the user stands in front of the toilet seat device 1, the predetermined portion 11*e*3 and the display 12 are hidden by the rear end part 21 of the toilet seat 20 and the front side part (upper step part 11*e*1) of the top face 11*e* and are difficult to see. It can be said that the predetermined portion 11*e*3 is located behind and below at least one of the front side part of the top face 11*e* and the rear end part 21 of the toilet seat 20.

Further, the upper surface of the rear end part 21 on the outer surface of the toilet seat 20, the seating surface S1 and the side surface S2 are formed by curved surfaces that smoothly connect each other. Further, when the toilet seat 20 is in the closed state P1, the upper surface and the side surface S2 of the rear end part 21 of the toilet seat 20 and the outer surface of the first lateral part 11*c* of the body part 10 are respectively formed so as to be arranged on the same curved surface that smoothly connects them to each other.

A pair of recesses 23 is provided on the back surface S3 of the rear end part 21 of the toilet seat 20 opposite to the seating surface S1 (see FIG. 2). When the toilet seat 20 is in the closed state P1, the pair of support parts 11*f* of the body part 10 are fitted in the pair of recesses 23.

Further, the toilet seat 20 is formed in a hollow shape having a substantially constant wall thickness. A heating device (not shown) for heating the seating surface S1 is accommodated in an outer contour 20*a* of the toilet seat 20. The heating device is configured using, for example, a cord heater (not shown) that generates heat when energized. Energization of the code heater is controlled by the control device 60 described later so that the temperature of the seating surface S1 becomes the set temperature (for example, 38° C.) set by the user.

The nozzle 30 is accommodated in the casing 11, and sprays washing water to wash a local area of a human body. The nozzle 30 is provided so as to be movable between a storage position in which the whole is stored in the casing 11 and a washing position (a position shown in FIG. 1) in which at least the a distal end part 31 is located outside the casing 11. When the nozzle 30 is located at the washing position, washing water is supplied from a water supply source (for example, water supply), and the washing water is jetted to clean the local area of the human body.

Further, the toilet seat device 1 includes a remote control device 50 as shown in FIG. 1. The remote control device 50 is for remotely operating the toilet seat device 1 by wire or wirelessly. The remote controller 50 includes a washing switch 51 for washing, a stop switch 52 for stopping washing, a power switch 53 for turning on/off the power, a power saving switch 54 for turning on/off the power saving mode, and a toilet seat temperature switch 55 for setting temperature of the toilet seat 20.

The control device 60 is accommodated in the casing 11 and integrally controls the toilet seat device 1. The control device 60 communicates with the remote control device 50 to acquire the on/off states of the switches 51 to 55. The control device 60 controls lighting and extinguishing of the light emitter 13 and energization of the code heater according to the on/off state of each of the switches 51 to 55. In addition, when the power saving mode described above is in the on state, for example, when the user is not seated on the seating surface S1, the control device 60 lowers the set temperature by a predetermined temperature (for example, 3° C.) to control so as to suppress the amount of electricity supplied to the heater.

When the user turns the power on by the power switch 53, the first light emitter 13*a* lights and the first thin-walled part 12*b*1 lights. When the user turns off the power with the power switch 53, the first light emitter 13*a* is turned off and the first thin-walled part 12*b*1 is turned off.

Similarly, when the user turns on the power saving mode with the power saving switch 54, the second light emitter 13*b* is turned on and the second thin-walled part 12*b*2 is turned on. When the user turns off the power saving mode with the power saving switch 54, the second light emitter 13*b* is turned off and the second thin-walled part 12*b*2 is turned off.

When the toilet seat device 1 is installed and the power is first turned on and the predetermined time has not elapsed, the third light emitter 13*c* is turned off, and thus the third thin-walled part 12*b*3 is off. When the predetermined time has elapsed from the time when the power was first turned on, the third light emitter 13*c* is turned on and the third thin-walled part 12*b*3 is turned on. As described above, the outer surface of the display 12 is formed by the same curved surface as the outer surface of the lower step part 11*e*2 of the top face 11*e*, and no step or gap is formed, therefore, when each light emitter 13*a*, 13*b*, 13*c* is off, it is difficult for the user to notice that the display 12 is provided in the predetermined portion 11*e*3.

According to some embodiments, the toilet seat device 1 includes the body part 10 having the casing 11 formed so as to be hollow, the toilet seat 20 formed so as to be hollow and supported by the casing 11, the light emitter 13 that is accommodated inside of the casing 11 and provided so as to emit light, and the display 12 that is provided at a predetermined portion 11*e*3 of the casing 11 and that indicates an operation state by light emission of the light emitter 13. The display 12 includes the base part 12*a* and the thin-walled part 12*b* which is formed to have a smaller thickness than the base part 12*a* and transmits the light emitted from the light emitter 13 to indicate the operation state.

According to some embodiments, the display 12 is provided in a predetermined portion 11*e*3, and transmits the light emitted from the light emitter 13 through the plurality of thin-walled parts 12*b* to display the operation state of the toilet seat device 1. Further, the plurality of thin-walled parts 12*b* are formed so as to have a smaller thickness than the base part 12*a*. Therefore, it is possible to provide the display 12 having no gap or step in the predetermined portion 11*e*3. Therefore, it is possible to prevent dirt from accumulating on the display 12 of the toilet seat device 1.

Further, the display 12 and the casing 11 are integrally formed.

According to some embodiments, the display 12 can be provided so that there is no gap or step in the casing 11 of the body part 10. Further, compared to the case where the predetermined portion 11*e*3 (display 12) and the casing 11 are formed separately, the number of parts of the body part 10 and thus the toilet seat device 1 can be reduced. Therefore, the cost of the toilet seat device 1 can be reduced.

Further, the plurality of thin-walled parts 12*b* are formed so as to be recessed from the inner side surface of the base part 12*a*.

According to some embodiments, it is possible to form the outer surface of the display 12 and the outer surface of the casing 11 so as to be flush with each other. Therefore, since water and dirt attached to the display 12 can be easily wiped off, the cleanability of the casing 11 of the body part 10 can be improved.

Further, the plurality of thin-walled parts 12*b* are formed by recessing in a cylindrical shape.

According to some embodiments, the thin-walled part 12*b* can be easily formed.

Further, the toilet seat 20 is provided so as to cover the top face 11*e* of the casing 11 when the toilet seat 20 is in the closed state P1.

According to some embodiments, in a case where the toilet seat 20 is formed so as to cover the top face 11*e* of the casing 11, as compared with the case where the toilet seat 20 is formed so as not to cover the top face 11*e*, the gap between the casing 11 and the toilet seat 20 can be reduced when viewed from above. Therefore, it is possible to easily remove water and dirt that have fallen from above the toilet seat device 1 and adhered to the toilet seat device 1.

Further, when the user looks at the toilet seat device 1 from the front or above, it is possible to make the gap between the body part 10 and the toilet seat 20 hard to see, so that the entire toilet seat device 1 has a clean design.

Further, the toilet seat device 1 further includes a nozzle 30 that is accommodated in the casing 11 and that washes the local area of the human body by ejecting washing water.

According to some embodiments, even in a case where the toilet seat device 1 is a warm water washing toilet seat, it has the same effect as the above-mentioned effect.

Next, with regard to the toilet seat device 1 according to some embodiments, the parts mainly different will be described with reference to FIG. 8. Although the display 12 is provided in the predetermined portion 11*e*3 of the casing 11, the display 112 is provided in the predetermined portion 120*b*1 of the toilet seat 120 integrally with the toilet seat 120. That is, the toilet seat 120 corresponds to one member of the present disclosure.

The predetermined portion 120*b*1 and also the display 112 is specifically provided on the top part 120*b* of the toilet seat 120. The top part 120*b* is the highest part of the outer contour 120*a* of the toilet seat 120. The top part 120*b* is the upper side of the rear end 121. Further, the light emitter 13 is accommodated in the outer contour 120*a* of the toilet seat 120. According to some embodiments, even in a case where the display 112 is provided on the outer contour 120*a* of the toilet seat 120, it is possible to prevent dirt from accumulating on the display 112.

Figure 9:
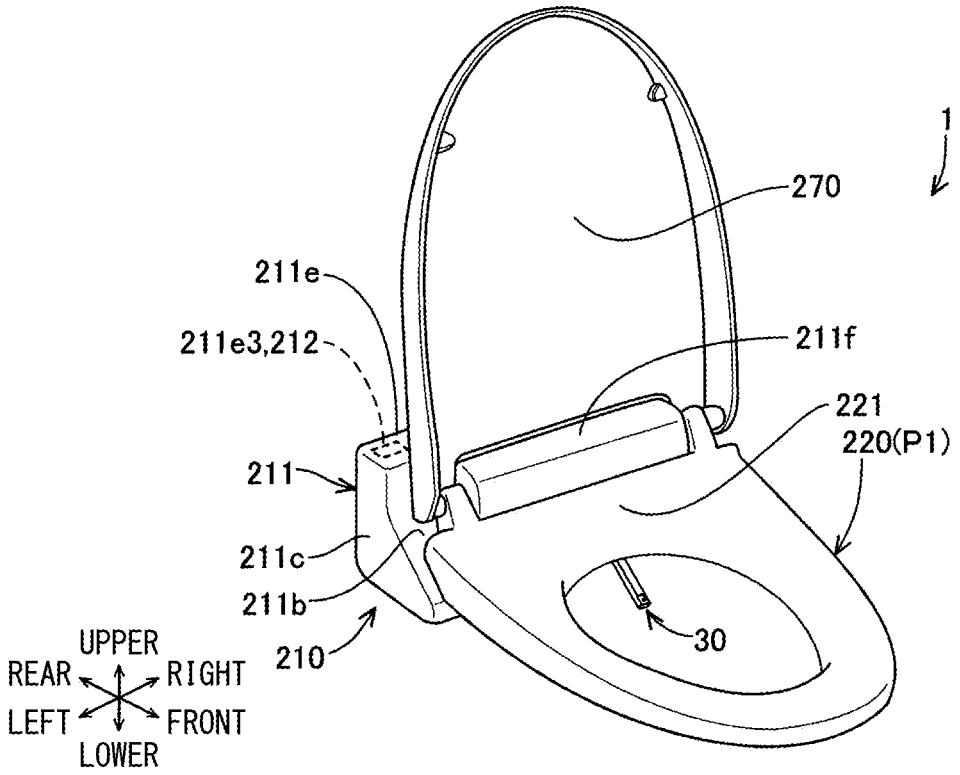
FIG. 9 is a perspective view of the toilet seat device, according to some embodiments.

Next, with regard to the toilet seat device 1, the parts mainly different will be described with reference to FIG. 9. The toilet seat 20 is provided so that the rear end part 21 covers the top face 11*e* of the casing 11, but the toilet seat 220 is provided so that the rear end part 221 only covers the front part 211*b* without covering the top face 211*e* of the casing 211. Further, only one support part 211*f* that supports the toilet seat 220 is provided on the front part 211*b* of the casing 211 so as to bulge forward. Further, the toilet seat device 1 includes a toilet lid 270 that is rotatably supported by the support part 211*f* of the casing 211 and covers the toilet seat 220. Further, the top face 211*e* of the casing 211 has no step. The display 212 is provided in a predetermined portion 211*e*3 of the top face 211*e*.

In addition, according to some embodiments, an example of the toilet seat device is shown, but the present disclosure is not limited to this, and other configurations can be adopted. For example, the toilet seat device 1 is a warm water washing toilet seat, but instead of this, it may be a heating toilet seat not having a washing function.

According to some embodiments, the plurality of thin-walled parts 12*b* are formed when the casing 11 is injection-molded, but instead of this, the casing 11 may be formed by being processed (for example, cut) after being injection-molded.

Further, the display 12 is provided at the left end part of the top face 11*e*, but instead of this, it may be provided at the right end part or the central part of the top face 11*e*. Further, it may be provided on the first lateral part 11*c* (predetermined portion 11*c*1) as in the display 312 shown in FIG. 3, or on the rear part 11*d* (predetermined portion 11*d*1) as in the display 412 shown in FIG. 4.

Figure 8:
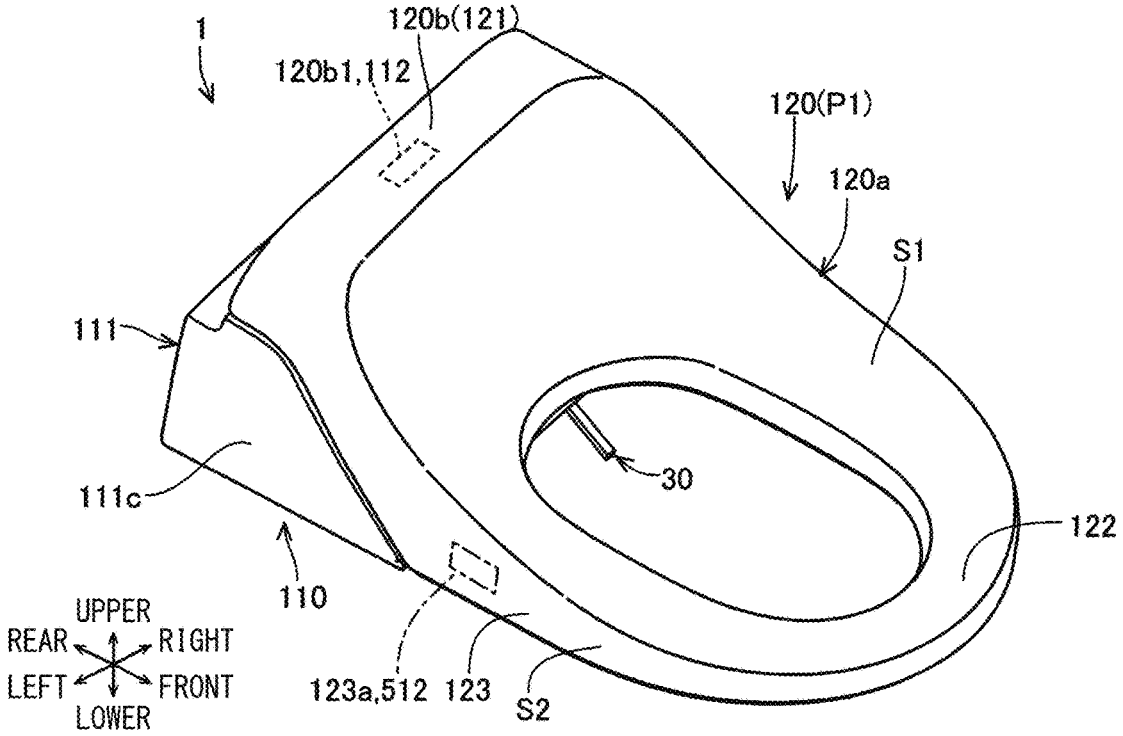
FIG. 8 is a perspective view of the toilet seat device, according to some embodiments.

In some embodiments, the display 112 is provided on the upper side of the rear end 121 of the outer contour 120*a* of the toilet seat 120 (the predetermined portion 120*b*1 of the top part 120*b*), but as in the display 512 shown in FIG. 8, the display may be provided on the second lateral part 123 (predetermined portion 123*a*) which is a lateral (left or right) part of the outer contour 120*a* of the toilet seat 120.

Further, in some embodiments, characters such as "power" are printed on the display 12, but instead of this, characters such as "power" may not be printed.

Figure 10:
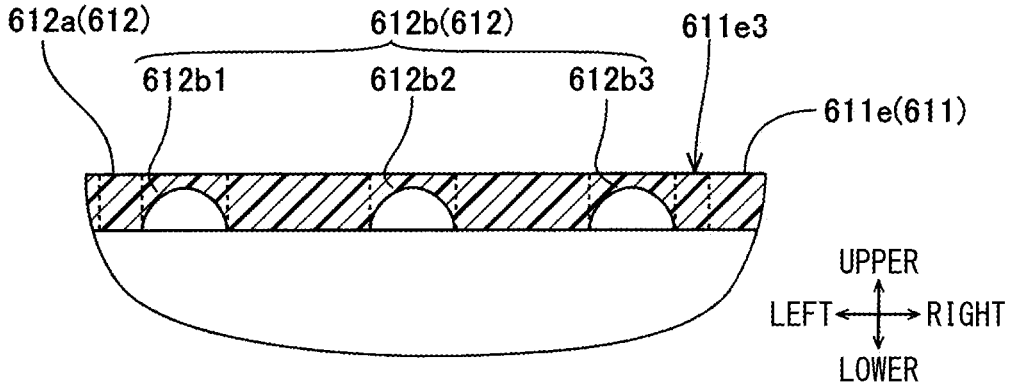
FIG. 10 is sectional drawing of the display, according to some embodiments.
Figure 11:
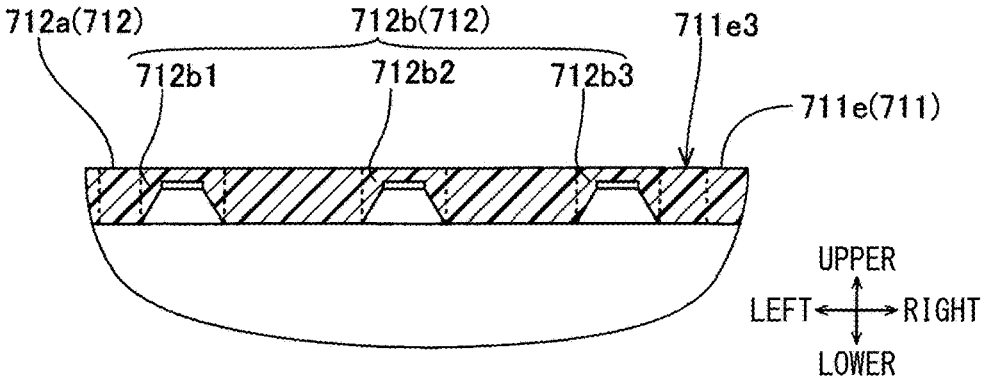
FIG. 11 is sectional drawing of the display, according to some embodiments.

Further, in some embodiments, the thin-walled part 12*b* is formed so as to be recessed in a cylindrical shape (see FIG. 7), but instead of this, as in the plurality of thin-walled parts 612*b* shown in FIG. 10, it may be formed so as to be recessed into a hemispherical shape. That is, the display 612 may include the base part 612*a* and the plurality of thin-walled parts 612*b* (612*b*1, 612*b*2, 612*b*3). Further, the thin-walled part 12*b* may be formed so as to be recessed into a truncated cone shape like the plurality of thin-walled parts 712*b* shown in FIG. 11. That is, the display 712 may include the base part 712*a* and the plurality of thin-walled parts 712*b* (712*b*1, 712*b*2, 712*b*3). According to some embodiments, since the degree of transmission of light from the light emitter 13 can be changed by the shape of the plurality of thin-walled parts 12*b*, 612*b*, 712*b*, it is possible to change the lighting range of the plurality of thin-walled parts 12*b*, 612*b*, 712*b* and the brightness when lighting.

Figure 12:
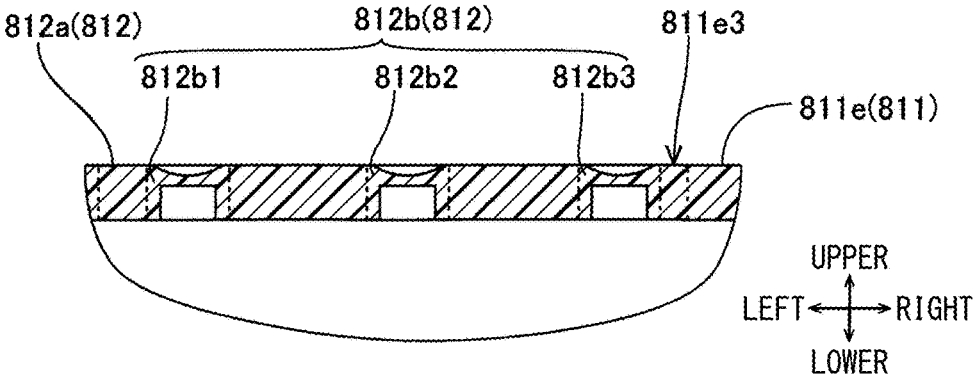
FIG. 12 is sectional drawing of the display, according to some embodiments.

Further, the thin-walled part 12*b* may be formed so as to be recessed from the inner side surface of the base part 812*a* like the plurality of thin-walled part 812*b* shown in FIG. 12, and may be formed so as to be recessed, for example, in a hemispherical shape from the outer surface of the base part 812*a*. That is, the display 812 may include the base part 812*a* and the plurality of thin-walled parts 812*b* (812*b*1, 812*b*2, 812*b*3). According to some embodiments, since the light emitter 13 is turned off, the position of the display 812 can be confirmed even when the plurality of thin-walled parts 812*b* are turned off. The plurality of thin-walled parts 812*b* may be formed so as to be recessed from the outer surface of the base part 812*a*. In this case, the plurality of thin-walled parts 812*b* are formed so as to be smoothly recessed so as not to have a step. The modified examples shown in FIGS. 10 to 12 described above can be applied even in a case where the display 112 is provided on the outer contour 120*a* of the toilet seat 120.

Figure 13:
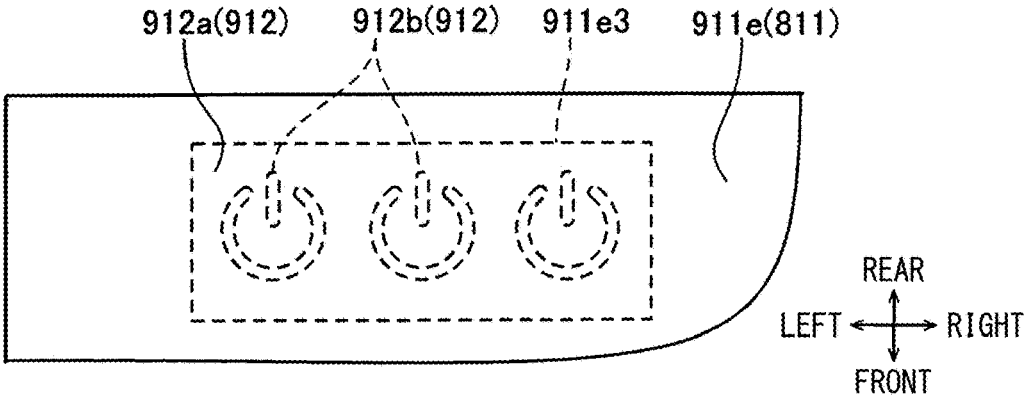
FIG. 13 is a top view of the display, according to some embodiments.

In addition, in some embodiments, the plurality of thin-walled parts 12*b*, 612*b*, 712*b*, 812*b* are formed to light up in a circular shape in a top view, but instead of this, like a plurality of thin-walled parts 912*b* shown in FIG. 13, it may be formed to light up in a shape of a pictogram. That is, the display 912 may include the base part 912*a* and the plurality of thin-walled parts 912*b*. In this case, the thin-walled part 912*b* is formed so as to be recessed in the shape of a pictogram from the inner surface of the base part 912*a*, for example. In these examples, the displays 612, 712, 812, 912 are provided at predetermined portions 611*e*3, 711*e*3, 811*e*3, 911*e*3 of the top faces 611*e*, 711*e*, 811*e*, 911*e* of the casings 611, 711, 811, 911.

In addition, in some embodiments, the toilet seat device 1 is installed in a public toilet room, but instead of this, it may be installed in a toilet room of a private home. In this case, the above-mentioned predetermined time serving as a guide for the inspection time may be, for example, 8 years.

Further, in some embodiments, the toilet seat device 1 includes the remote control device 50, but instead of this, the toilet seat device 1 may not be provided with the remote control device 50, and each of the switches 51 to 55 may be provided in the body part 10.

Further, in some embodiments (see FIGS. 1 to 13), the displays 12, 112, 212, 312, 412, 512, 612, 712, 812, 912 indicate the operation state of the toilet seat device 1, but instead of this, the abnormality of the toilet seat device 1 may be notified by a combination of blinking and lighting of the light emitters 13*a*, 13*b*, 13*c*.

In some embodiments, the displays 12 to 912 and one of the casings 11, 111, 211, 611, 711, 811, 911 and the toilet seat 120 are integrally formed, but Instead of this, the displays 12 to 912 and one of the casings 11 to 911 and the toilet seat 120 may be provided separately. In this case, the displays 12 to 912 and one of the casings 11 to 911 and the toilet seat 120 may be coupled with each other by using screws or the like, or may be bonded by welding, an adhesive or the like. According to some embodiments, as compared with the case where the protection member is provided as in the prior art, the displays 12 to 912 can be easily assembled to one of the casings 11 to 911 and the toilet seat 120, and the outer surfaces of the displays 12 to 912 can be formed so that there are no steps or gaps in the predetermined portions 11*e*3, 211*e*3, 611*e*3, 711*e*3, 811*e*3, 911*e*3, 11*c*1, 11*d*1, 120*b*1, 123*a*.

Further, without departing from the scope of the present disclosure, the shapes of the casings 11 to 911, the toilet seats 20, 120, 220, the predetermined portions 11*e*3 to 911*e*3, 11*c*1, 11*d*1, 120*b*1, 123*a*, the displays 12 to 912, and a plurality of thin-walled parts 12*b* to 912*b* may be changed. Further, the type of the light emitter 13 and the color of light may be changed. Further, the number of the plurality of thin-walled parts 12*b* to 912*b*, the size of the plurality of thin-walled parts 12*b*, 612*b*, 712*b*, 812*b*, 912*b*, the top part 120*b*, the predetermined portions 11*e*3 to 911*e*3, 11*c*1, 11*d*1, 120*b*1, 123*a* and the displays 12 to 912, and the position and range of the casings 11 to 911 or the toilet seat 120 with respect to the outer contour 120*a* may be changed.

According to some embodiments, the display is provided at a predetermined portion, and the thin-walled part allows the light emitted from the light emitter to pass therethrough, thereby displaying the operation state of the toilet seat device. Further, the thin-walled part is formed so as to have a smaller thickness than the base part. Therefore, it is possible to provide the display having no gap or step at the predetermined portion. Therefore, it is possible to prevent dirt from accumulating on the display of the toilet seat device.

The invention claimed is:

1. A toilet seat device comprising:

a body part including a hollow casing;

a toilet seat configured to be hollow and supported by the hollow casing;

a light emitter accommodated in one of the hollow casing and the toilet seat, the light emitter being configured to emit light; and a display provided at a prescribed location on the one of the hollow casing and the toilet seat, the display being configured to indicate an operation state by light emitted by the light emitter, wherein the display includes:

a base part; and a thin-walled part configured to have a smaller thickness than the base part, the thin-walled part being configured to transmit the light to indicate the operation state, and the display and the one of the hollow casing and the toilet seat are integrally formed.

2. The toilet seat device of claim 1, wherein the thin-walled part and the one of the hollow casing and the toilet seat are integrally formed.

3. The toilet seat device of claim 1, wherein the thin-walled part is recessed from an inner surface of the base part.

4. The toilet seat device of claim 3, wherein the thin-walled part is recessed in a cylindrical shape from the inner surface of the base part.

5. The toilet seat device of claim 3, wherein the thin-walled part is recessed into a hemispherical shape from the inner surface of the base part.

6. The toilet seat device of claim 3, wherein the thin-walled part is recessed in a truncated cone shape from the inner surface of the base part.

7. The toilet seat device of claim 3, wherein the thin-walled part is recessed in a pictogram shape from the inner surface of the base part.

8. The toilet seat device of claim 1, wherein the thin-walled part is recessed from an outer surface of the base part.

9. The toilet seat device of claim 8, wherein the thin-walled part is recessed into a hemispherical shape from the outer surface of the base part.

10. The toilet seat device of claim 1, wherein the toilet seat is configured to cover a top face of the hollow casing in a case where the toilet seat is in a closed state.

11. The toilet seat device of claim 1, wherein the one of the hollow casing and the toilet seat is the toilet seat, and the display is provided on a top part of the toilet seat.

12. The toilet seat device of claim 1, wherein the one of the hollow casing and the toilet seat is the toilet seat, and the display is provided on an outer contour of the toilet seat.

13. The toilet seat device according to claim 1, wherein the one of the hollow casing and the toilet seat is the hollow casing, and the display is provided in a predetermined portion on a top face of the casing, the predetermined portion being located rearward and downward of at least one of a front side part of the top face and a rear end part of the toilet seat.

* * * * *